United States Patent [19]

Tamada

[11] 3,935,702

[45] Feb. 3, 1976

[54] INVERTIBLE TIMER

[76] Inventor: Koji Tamada, 705 Yamate Mansion, 81 Nakaodai, Naka, Yokohama, Kanagawa, Japan

[22] Filed: Dec. 5, 1973

[21] Appl. No.: 421,914

[30] Foreign Application Priority Data

| | | |
|---|---|---|
| Dec. 8, 1972 | Japan | 47-140382 |
| Feb. 5, 1973 | Japan | 48-14795 |
| Nov. 2, 1973 | Japan | 48-127397 |

[52] U.S. Cl. ..... 58/144

[51] Int. Cl.[2] ..... G04F 1/06

[58] Field of Search ..... 58/144

[56] References Cited

UNITED STATES PATENTS

| | | | |
|---|---|---|---|
| 3,505,873 | 4/1970 | Cornelison et al. | 58/144 X |
| 3,533,229 | 10/1970 | Liljequist | 58/144 |
| R23,612 | 1/1953 | Abel | 58/144 X |

*Primary Examiner*—Edith Simmons Jackmon

[57] ABSTRACT

An invertible timer comprises a closed transparent vessel having upper and lower chambers with a throttle therebetween, said vessel being filled with a transparent liquid in which there is a quantity of granular material, so that such material is protected from being electrostatically charged and its rate of fall is somewhat lessened. As the material fall in the liquid, a comparatively long time indication is obtained, with a small amount of material. A turn wheel in each chamber is turned by the material to show at a distance the states of time counting and termination of such counting.

3 Claims, 6 Drawing Figures

INVERTIBLE TIMER

This invention relates to an improved invertible timer comprising a closed vessel made of transparent glass having upper and lower chambers divided by a throttle portion and containing therein a substantial amount of small granular material.

In the conventional timer of this kind, sands passing through the throttled portion tend to be electrostatically charged due to friction, whereby the charged sands are attracted to the wall of the glass vessel. This causes some errors in time keeping.

Also, to make it possible to ascertain whether or not the time period to be measured by the timer has expired, even a small amount of sand stream falling down through the throttle should be readily observable. As the vessel is transparent, if the sand flowing down is too fine, it is very difficult to definitely detect the moment that the upper chamber of the vessel is completely emptied, that is, the moment when the last sand falls down. This is partly because matter at the back of the vessel comes into view as a background that can be confused with the falling sand.

One object of the present invention is to prevent granular material in a closed vessel from being electrostatically charged.

Another object of the present invention is to give a buoyancy to granular material so that their weight is lightened and as they flow down, due to fluid resistance, their flowing time is prolonged; thus the timer is enabled to provide a time indication for a long time interval.

A further object of the present invention is to provide a timer in which the falling and the static states of the granular material in the glass are readily observable and distinguishable.

Still another object of the present invention is to provide a timer in which there is a wheel that is rotated by falling sand, so that it is readily possible to determine whether or not granular material is falling by observing whether the wheel is turning or not, and wherein buoyancy is given to the wheel, to reduce frictional resistance of the shaft when the wheel turns.

A still further object of the present invention is to provide a timer comprising a closed vessel that will not be damaged even when the volume of liquid which fills the transparent vessel varies due to sudden change of temperature.

The most suitable timer for achieving these objects of the present invention comprises a closed transparent vessel having upper and lower chambers divided by a throttled portion, and in which granular material is contained; said closed vessel also being filled with a liquid and having its ends covered with resilient sealing material; the rear side of the vessel being covered with an opaque plate, and the vessel further having a turn wheel pivotally mounted to a shaft in each of its chambers.

Further details of the present invention will become apparent as the following description proceeds, with reference to the accompanying drawings in which.

Figure 1:
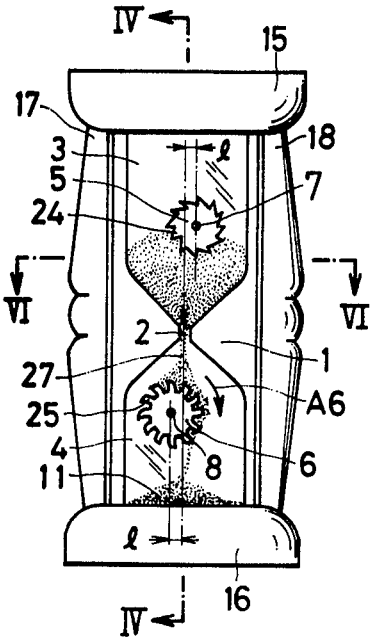
FIG. 1 is a front view of a timer of the present invention.
Figure 2:
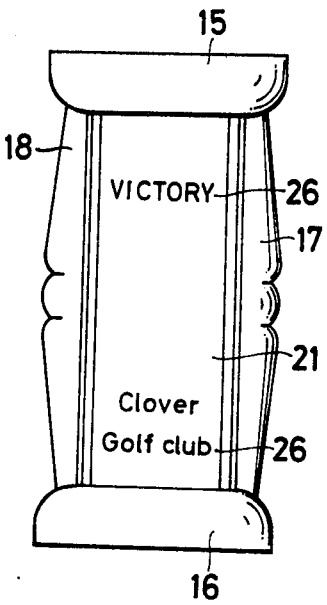
FIG. 2 is its back view.
Figure 3:
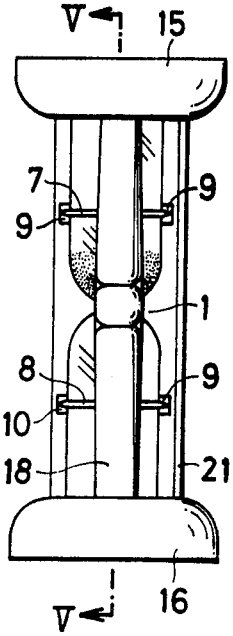
FIG. 3 is its side view.
Figure 4:
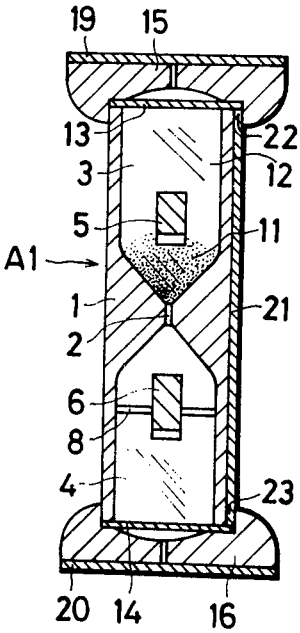
FIG. 4 is a cross section view taken along the line IV—IV in FIG. 1.
Figure 5:
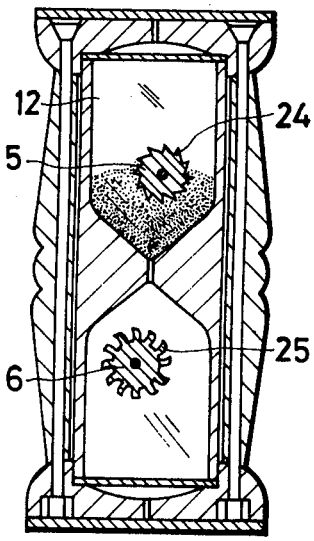
FIG. 5 is a cross section view taken along the line V—V in FIG. 3.
Figure 6:
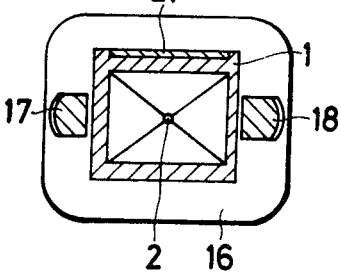
FIG. 6 is a cross section view taken along the line VI—VI in FIG. 1.

In the drawings, there is shown a closed vessel 1 made of synthetic resin or glass. At its center, a throttle 2 is formed so that the vessel is divided into an upper chamber 3 and lower chamber 4. Each chamber is provided with a turn wheel 5, 6. The shaft 7, 8 for each turn wheel 5, 6 is supported by bearings 9, 10. The vessel contains a quantity 11 of sandlike granules which can be in the form of glass balls having a diameter of about 0.3 – 0.4 mm. 12 is a liquid such as water filled in the vessel 1. 13, 14 are resilient plates such as rubber, synthetic rubber or metal diaphragm which close the remote ends of the chambers 3 and 4, respectively. These sealing plates are overlain by end caps 15 and 16, respectively, which are connected by connector columns 17 and 18. Cover plates 19 and 20 in turn overlie the respective end caps 15 and 16. 21 is an upright opaque plate overlying the rear side of the closed vessel 1. 22, 23 are recesses provided in the end caps 15, 16 in which the upper and lower ends of said opaque plate 21 are inserted. 26 is an indication on the outside of the opaque plate 21. This may be preprinted on the plate with any letters or figures.

Each turn wheel 5, 6 has blades 24, 25. Each of the shafts 9, 10 for the respective wheels 5 and 6 is fixed in a position displaced by a distance 1 from the vertical center line passing through the throttle 2, the two shafts being spaced to opposite sides of said center line and, of course, extending transverse thereto.

As shown in FIG. 1, when granular material 11 in the upper chamber 3 drop through the throttle 2 into the lower chamber 4, said granular material contact the blades 25 of the turn wheel 6 to turn it in direction of arrow A6. In this instance, granular material do not tend to be electrostatically charged as it is submerged in the liquid. Also due to buoyancy, the gravity of the granular material is somewhat lessened, and its falling speed is also reduced because the frictional resistance presented by the liquid is large as compared to that presented by a gas. As a result, even with small amount of granular material, time counting may be made comparatively for a long time.

Turn wheels 5, 6 are also submerged in the liquid, so that they are given buoyancy with the result that shafts 7, 8 bearing the wheels are less loaded and in turn, the frictional resistance of the bearings is diminished. In consequence the rotation of the turn wheels is effected smoothly.

Further, since the opaque plate 21 covers the rear side of the closed vessel 1, nothing behind the opaque plate 21 comes in sight when one views the closed vessel 1 from the direction of arrow A1, whereby the falling state of the granular material and its subsequent state can be easily perceived.

The invention of this application is not limited only to the above. Any modification may be made without departing from the spirit of the present invention as defined by the appended claims.

What is claimed is:

1. An invertible timer comprising a closed vessel having upper and lower chambers divided by a throttle portion, each chamber enclosing a substantial amount of granular material, said invertible timer being characterized by:

A. said closed vessel being filled with liquid;

B. an opaque plate overlying the rear side of said closed vessel;

C. a turn wheel rotatable in each of the upper and lower chambers of said closed vessel; and D. resilient sealing members at the ends of said closed vessel.

2. The invertible timer of claim 1 wherein the material of the vessel is a transparent resin and the granular material comprises substantially spherical particles of glass.

3. The invertible timer of claim 1, wherein each of said turn wheels comprises:

a bladed wheel mounted in the chamber for free rotation on a shaft that is substantially transverse to the axis of the throttled passage and spaced to one side thereof, so that granular material falling through said passage strikes the blades at one side of the wheel in the lower chamber and imparts rotation to said wheel whereby the falling of the granular material is rendered readily visible.

* * * * *